US007435140B2

(12) United States Patent
Wang

(10) Patent No.: US 7,435,140 B2
(45) Date of Patent: Oct. 14, 2008

(54) ELECTRICAL CONNECTOR

(75) Inventor: Long-Fei Wang, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/784,916

(22) Filed: Apr. 10, 2007

(65) Prior Publication Data

US 2007/0238357 A1 Oct. 11, 2007

(51) Int. Cl.
*H01R 13/648* (2006.01)

(52) U.S. Cl. ..... 439/607

(58) Field of Classification Search ..... 439/607, 439/608, 660, 70, 680, 681; 361/818
See application file for complete search history.

(56) References Cited

U.S. PATENT DOCUMENTS 6,165,008 A * 12/2000 Wu et al. ..... 439/492
6,238,227 B1 * 5/2001 Wu et al. ..... 439/260
6,315,616 B1 * 11/2001 Hayashi ..... 439/638
6,419,524 B1 * 7/2002 Ma ..... 439/607
2002/0064998 A1 * 5/2002 Handa et al. ..... 439/607
2006/0063431 A1 3/2006 Yang

FOREIGN PATENT DOCUMENTS

CN 2766377 Y 3/2006

* cited by examiner

*Primary Examiner*—Alexander Gilman
(74) *Attorney, Agent, or Firm*—Wei Te Chung

(57) ABSTRACT

An electrical connector includes a shield (1), a flexible printed circuit (2) and a support element (4). The shield has a receiving space (10) and a pair of sidewalls (12). Each sidewall defines thereon a pair of open slots (125) to form a body portion (121) disposed above said open slots. Each body portion has a pair of opposite free ends projecting toward the receiving space to form a pair of resilient portions for standing against the electrical element. The flexible printed circuit is received in the receiving space for electrically connecting the electrical element. The support element upholds the flexible printed circuit for maintaining an electrical connection between the flexible printed circuit and the electrical element.

14 Claims, 4 Drawing Sheets

ELECTRICAL CONNECTOR

BACKGROUND OF THE INVENTION

1. Field of the Invention

The present invention relates to an electrical connector, and particularly to an electrical connector, in which an electrical element such as a camera module is firmly fitted.

2. Description of Prior Arts

A Chinese Patent No. 2766377 issued on Mar. 22, 2006, discloses such a connector. The electrical connector for receiving a camera module comprises a lower shield, an upper shield, a support element and an FPC (Flexible Printed Circuit). The shields together define a bottom wall, a primary wall, an end wall and a pair of periphery walls, and a receiving space enclosed by the walls. Each periphery wall has an anti-mismating indentation defined thereon for engaging with a protrusion formed on the module, and a pair of protruding sections projecting outwardly from an outer surface thereof for engaging with a plurality of recesses defined on the upper shield.

However, the walls of the lower shield described above could not provide sufficient resilient force to firmly fasten the camera module to the connector.

U.S. Pat No. 2006/0063431 published on Mar. 23, 2006, discloses a connector for receiving an electrical element. The electrical connector comprises a shield, an insulative housing and a plurality of terminals. The shield comprises four separated shielding plates and a bottom shield. Each shielding plate includes a plurality of U-shaped flexible plates each having a free end extending downwardly and inwardly for resisting against the electrical element. However, the configuration of the shield is so complicated that it is difficult to manufacture and demands a lot of material.

Hence, it is desirable to provide an improved electrical connector to overcome the aforementioned disadvantages.

SUMMARY OF THE INVENTION

An object of the present invention is to provide an electrical connector adapted for firmly fastening an electrical element.

To achieve the above object, an electrical connector for receiving therein an electrical element comprises a shield, a flexible printed circuit and a support element. The shield has a receiving space and a pair of sidewalls. Each sidewall defines thereon a pair of open slots to form a body portion disposed above said open slots. Each body portion has a pair of opposite free ends projecting toward the receiving space to form a pair of resilient portions for standing against the electrical element. The flexible printed circuit is received in the receiving space for electrically connecting the electrical element. The support element upholds the flexible printed circuit for maintaining an electrical connection between the flexible printed circuit and the electrical element.

Advantages of the present invention are to provide a shield formed with a pair of improved sidewalls having sufficient resilient force for firmly fastening the electrical element. The configuration of the shield is so simple that it is easy to manufacture, and a lot of material could be saved.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
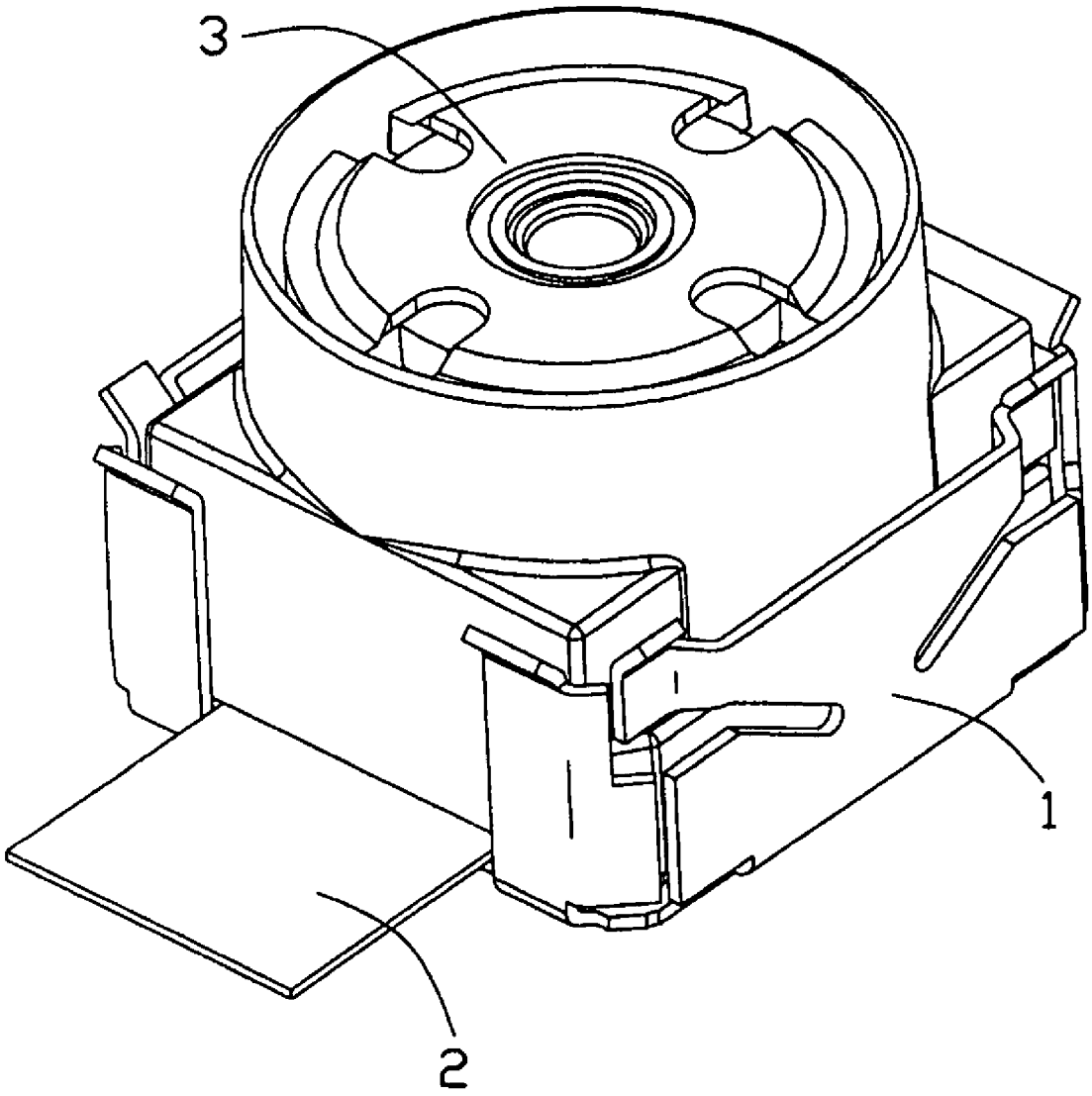
FIG. 1 is an assembled perspective view of an electrical connector in accordance with the present invention, with an electrical element retained therein.
Figure 2:
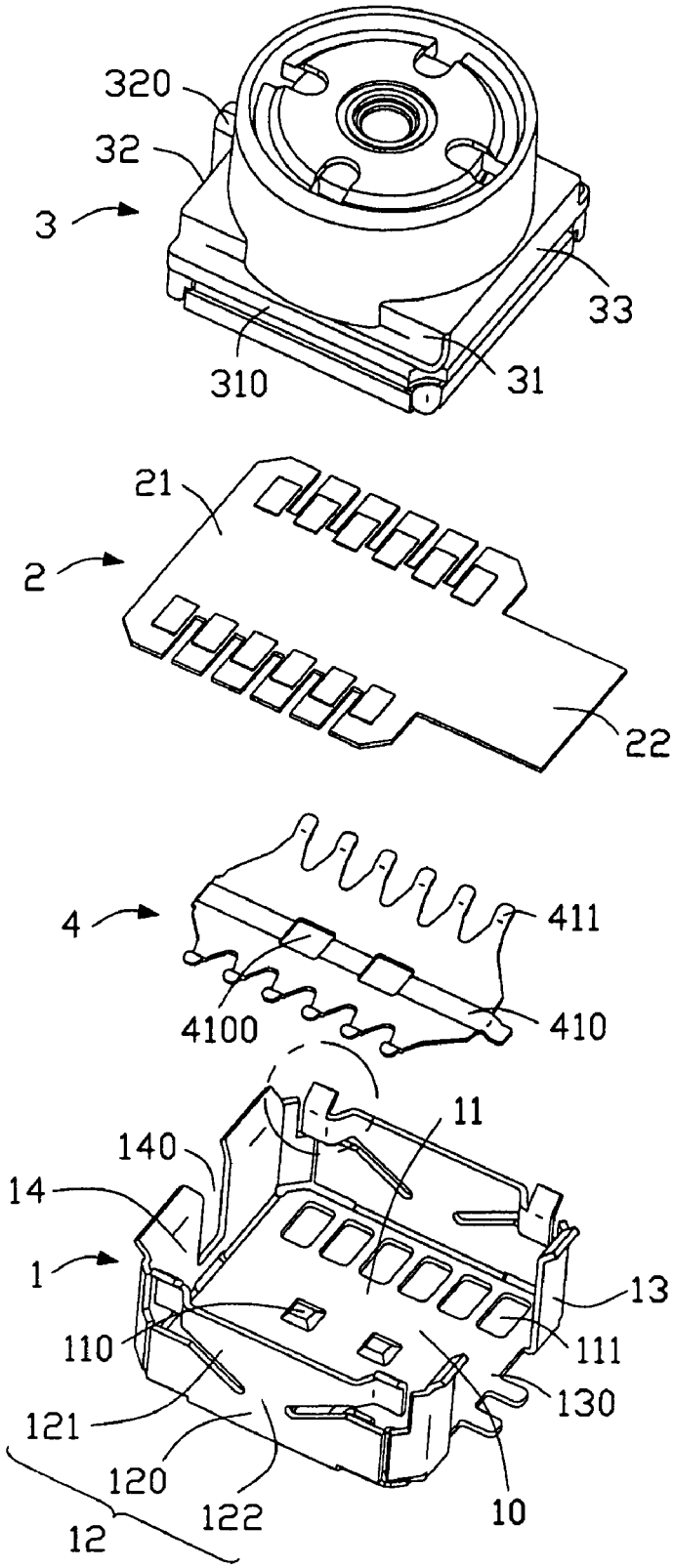
FIG. 2 is an exploded perspective view of the electrical connector as shown in FIG. 1.
Figure 3:
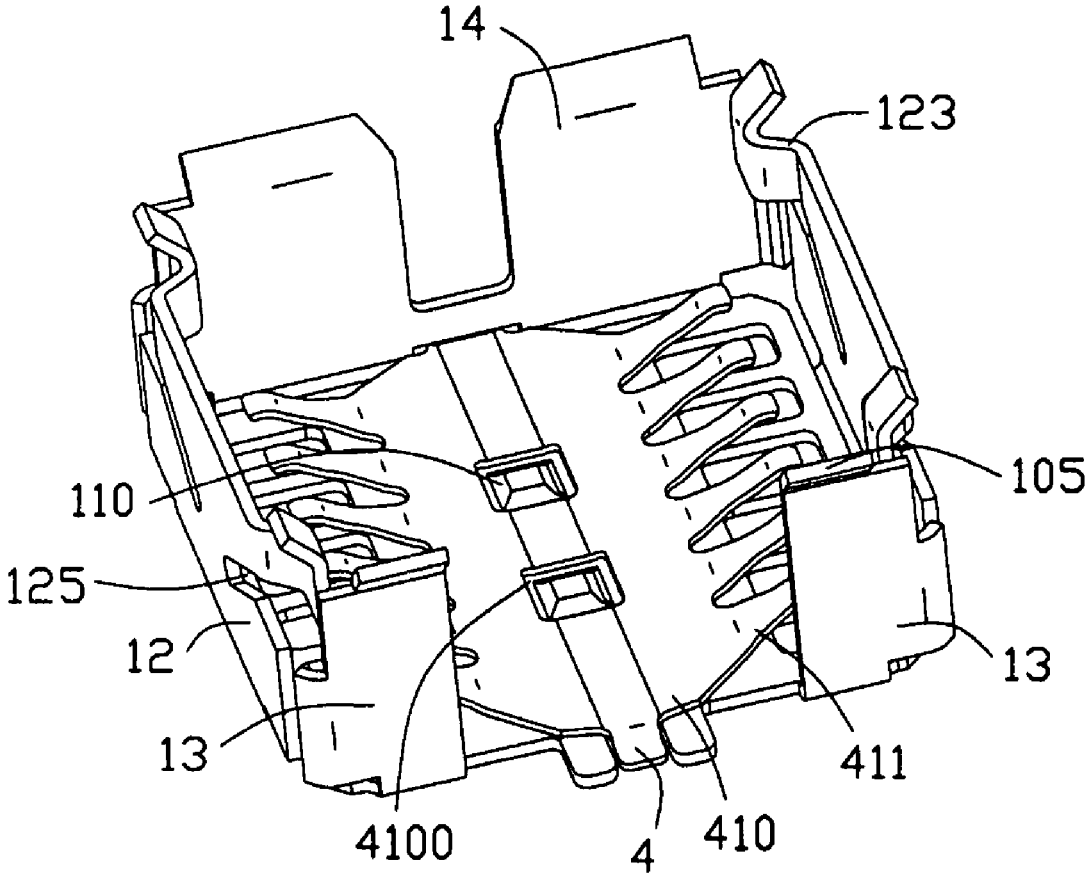
FIG. 3 is an assembled perspective view of the electrical connector as shown in FIG. 2, with the electrical element being removed.

Reference will now be made to the drawing figures to describe the present invention in detail. Referring to FIGS. 1-4, an electrical connector in accordance with the present invention is adapted for firmly fastening an electrical element. The electrical element referred to in this embodiment is a camera module 3. The electrical connector comprises a shield 1 defining a receiving space 10, a support element 4 and a flexible printed circuit 2 mounted in the receiving space 10 of the shield 1 in sequence.

Figure 4:
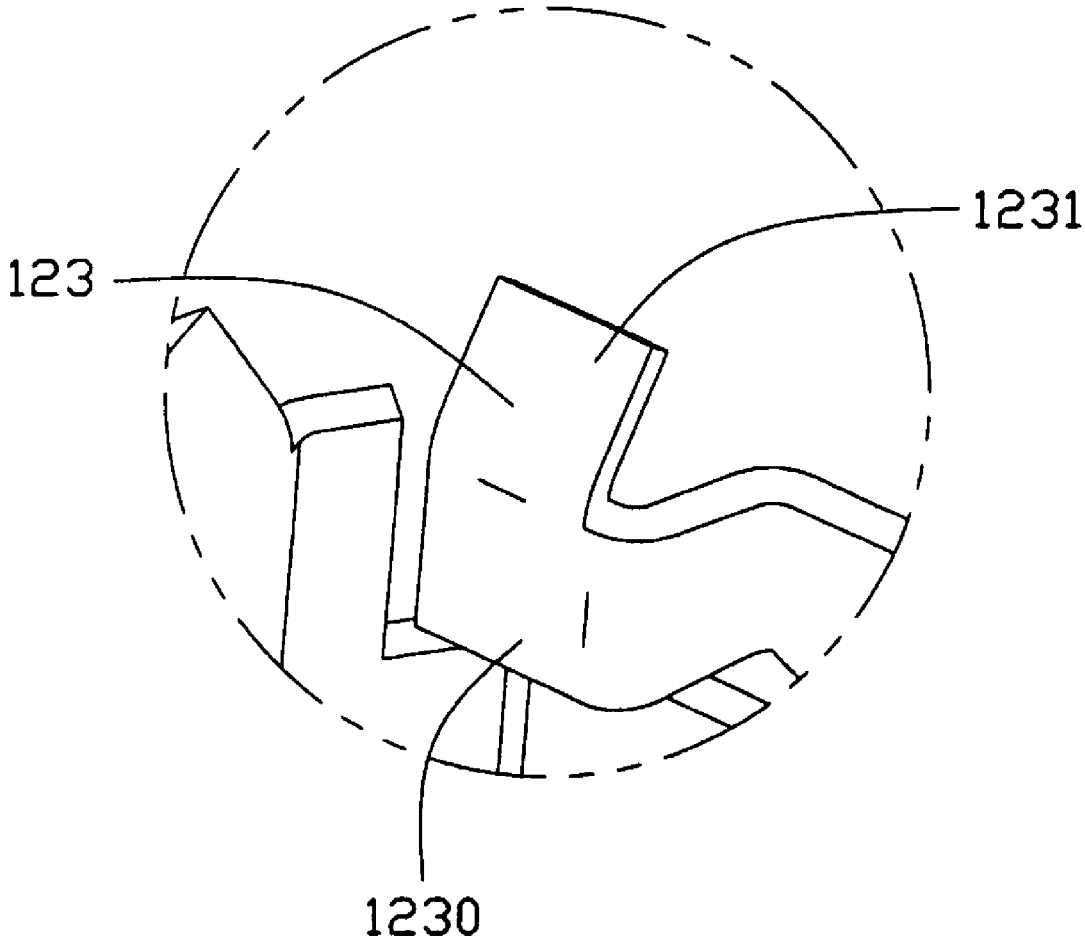
FIG. 4 is a partially enlarged perspective view of a resilient portion as shown in FIG. 2.

The shield 1 comprises a bottom wall 11, a primary wall 13, a pair of opposite sidewalls 12 and an end wall 14 interconnected together to thereby define the receiving space 10. The bottom wall 11 includes a pair of protrusions 110 protruding upwardly from a center portion of an inner surface thereof, and a plurality of slots 111 symmetrically defined along two opposite edges thereof. The primary wall 13 has a cutout 130 defined in a middle portion thereof for partial extension of the flexible printed circuit 2. A pair of open slots 125 are defined on the sidewall 12 to divide it into an body portion 121 and a lower base portion 120. The pair of open slots 125 extend obliquely upwardly and then horizontally so that the body portion 121 is substantially shaped as a triangle. Each body portion 121 has a pair of opposite free ends projecting toward the receiving space 10 to form a pair of resilient portions 123 for standing against the camera module 3. The sidewall 12 has a connection portion 122 formed between lower ends of the pair of open slots 125 and connecting the body portion 121 to the lower base portion 120. Referring to FIG. 4, each resilient portion 123 further comprises a fixing portion 1230 projecting toward the receiving space for standing against the camera module 3 and a first guiding portion 1231 formed above the resilient portion 123 for guiding the camera module 3. The end wall 14 includes an anti-mismating indentation 140 defined at a center portion thereof for receiving an anti-mismating protrusion 320 formed on the camera module 3. The primary wall 13 and the end wall 14 are respectively formed with a pair of second guiding portions 105 extending outwardly from a top portion thereof for guiding the camera module 3.

The support element 4 is of a fishbone configuration and comprises a main portion 410 disposed above the bottom wall 11 of the shield 1, a plurality of flexible portions 411 upwardly extending from opposite sides of the main portion 410 for upholding the flexible printed circuit 2. The main portion 410 has a pair of receiving holes 4100 for receiving corresponding protrusions 110 of the bottom wall 11. When the symmetrical flexible portions 411 are pressed downwardly by the camera module 3, the flexible portions 411 can be received in the slots 111 of the bottom wall 11.

The flexible printed circuit 2 comprises a first portion 21 and a second portion 22. The first portion 21 is located in the receiving space 10, with a top surface thereof contacting with the camera module 3 and a bottom surface thereof being resisted against by the flexible portions 411 of the support element 4. The second portion 22 extends outwardly though the cutout 130 for electrically connecting to a printed circuit board (not shown).

The camera module 3 has a side face 31, a primary face 33 and an end face 32. Each side face 31 has a protrusion 310 projecting outwardly therefrom. The end face 32 is formed with an anti-mismating protrusion 320.

In assembling the electrical connector, the support element 4 and the flexible printed circuit 2 are assembled in the receiving space 10 in sequence. The support element 4 is inserted into the shield 1 in a top-to-bottom direction, with the pair of protrusions 110 of the bottom wall 11 of the shield 1 being received in the corresponding receiving holes 4100 of the main portion 410 of the support element 4.

When the camera module 3 is guided in, the fixing portions 1230 of the pair of sidewalls 12 are pressed and deflected outwardly. When the camera module 3 is completely inserted in, the fixing portions 1230 abut against the protrusions 310. The anti-mismating protrusion 320 is received in the anti-mismating indentation 140. The support element 4 provides sufficient resilient force for tightly connecting the camera module 3 with the flexible printed circuit 2.

The body portion 121 is connected to the lower base portion 120 via the connection portion 122, which is formed between lower ends of the pair open slots 125 and therefore has a width much smaller than that of the body portion 121. Therefore, the body portion 121 is flexible and the resilient portions 123 formed thereon would provide sufficient resilient force to firmly fasten the camera module 3 in the receiving space 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claim is:

1. An electrical connector for receiving an electrical element, comprising:

a shield having a bottom wall and a pair of sidewalls and defining a receiving space, each sidewall defining a pair of open slots to form an upper body portion and a lower base portion, each pair of open slots extending obliquely upwardly and then horizontally between the lower base portion and the body portion, each body portion having a pair of resilient portions projecting toward the receiving space for standing against the electrical element;

a flexible printed circuit received in the receiving space for electrically connecting the electrical element; and a support element placed on the bottom wall and upholding the flexible printed circuit for maintaining an electrical connection between the flexible printed circuit and the electrical element.

2. The electrical connector as claimed in claim 1, wherein the body portion is substantially triangle-shaped.

3. The electrical connector as claimed in claim 1, wherein each side wall has a connection portion formed between lower ends of the pair of open slots and connecting the body portion to the lower base portion.

4. The electrical connector as claimed in claim 1, wherein each resilient portion has a fixing portion engaging with the electrical element, and a first guiding portion formed above the fixing portion for guiding the electrical element into the receiving space.

5. The electrical connector as claimed in claim 1, wherein said shield comprises the bottom wall, a primary wall, an end wall and the pair of sidewalls to define the receiving space.

6. The electrical connector as claimed in claim 5, wherein said end wall comprises an anti-mismating indentation for receiving an anti-mismating protrusion formed on the electrical element.

7. The electrical connector as claimed in claim 5, wherein said primary wall and the end wall respectively have a pair of second guiding portions extending outwardly from a top portion thereof for guiding the electrical element.

8. The electrical connector as claimed in claim 5, wherein said primary wall has a cutout defined at a middle portion thereof, and wherein the flexible printed circuit comprises a first portion received in the receiving space and a second portion extending outwardly through the cutout for electrically connecting to a printed circuit board.

9. The electrical connector as claimed in claim 1, wherein said bottom wall comprises a plurality of slots symmetrically defined along two opposite edges thereof for receiving the flexible portions when the electrical element is inserted.

10. The electrical connector as claimed in claim 1, wherein said support element has a main portion and a plurality of flexible portions bent upwardly from opposite sides of the main portion.

11. The electrical connector as claimed in claim 1, wherein said support element comprises a pair of receiving holes and wherein said bottom wall comprises a pair of protrusions protruding upwardly for engaging with corresponding receiving holes.

12. An electrical connector assembly comprising:

a metallic shell defining a bottom wall and a plurality of peripheral walls extending from the bottom wall;

at least one peripheral wall defining an opening to allow a flexible printed circuit (FPC) to extend therethrough laterally and horizontally;

at least an upward protrusion formed on an upper face of the bottom wall; and a resilient support element sandwiched between the bottom wall and the FPC and defining an aperture to receive said protrusion therein; wherein the bottom wall and the peripheral walls commonly define an upward receiving cavity so as to allow a camera module to be downwardly loaded thereinto under a condition that the camera module cooperates with the resilient support element to sandwich the FPC therebetween.

13. An electrical connector for receiving an electrical element, comprising:

a shield having a bottom wall and a plurality of sidewalls and defining an upward receiving space to receive said electrical element therein, a pair of resilient portions respectively having fixing portions projecting toward the receiving space to stand against the electrical element;

a flexible printed circuit (FPC) receiving in the receiving space to electrically connect the electrical element; and a metallic Support element placed on the bottom wall and upholding the flexible printed circuit, to cooperate with the resilient portions for maintaining an electrical connection between the flexible printed circuit and the electrical element.

14. The electrical connector assembly as claimed in claim 13, wherein said fixing portion further has an upward and outward guiding portion extending therefrom.

* * * * *